US007868566B2

(12) United States Patent
Bechtold et al.

(10) Patent No.: US 7,868,566 B2
(45) Date of Patent: Jan. 11, 2011

(54) METHOD FOR ADJUSTING A PISTON IN A LINEAR COMPRESSOR

(75) Inventors: Mario Bechtold, Hemhofen (DE); Johannes Reinschke, Nürnberg (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 281 days.

(21) Appl. No.: 12/224,515

(22) PCT Filed: Jan. 25, 2007

(86) PCT No.: PCT/EP2007/050745

§ 371 (c)(1),
(2), (4) Date: Oct. 27, 2008

(87) PCT Pub. No.: WO2007/099000

PCT Pub. Date: Sep. 7, 2007

(65) Prior Publication Data

US 2009/0153081 A1 Jun. 18, 2009

(30) Foreign Application Priority Data

Feb. 28, 2006 (DE) ..... 10 2006 009 230

(51) Int. Cl.
*F25B 1/02* (2006.01)
*F04B 35/04* (2006.01)
*H02K 41/02* (2006.01)

(52) U.S. Cl. ..... 318/135; 417/417; 417/398; 62/226; 62/228.1

(58) Field of Classification Search ..... 318/135, 318/437, 556, 686, 687; 310/12.01, 15, 23; 417/416, 417, 338, 343, 398, 399; 92/162 R; 62/196.2, 196.3, 215, 226, 228.1, 228.4, 62/498
See application file for complete search history.

(56) References Cited

U.S. PATENT DOCUMENTS 5,032,772 A * 7/1991 Gully et al. ..... 318/135

(Continued)

FOREIGN PATENT DOCUMENTS

CH 604 004 8/1978

OTHER PUBLICATIONS

International Search Report PCT/EP2007/050745.

*Primary Examiner*—Walter Benson
*Assistant Examiner*—Eduardo Colon
(74) *Attorney, Agent, or Firm*—James E. Howard; Andre Pallapies

(57) ABSTRACT

A method for operating a linear compressor including a linear drive with a stator and a rotor configured for displacement by a magnetic field of the stator against a spring force, and a compression chamber which is delimited by a displaceable piston coupled to the rotor during the operation of which an alternating current is applied to the stator in order to drive the rotor in an reciprocatingly, the method including the steps of applying, prior to operation, a direct current with a first polarity to the stator in order to displace the rotor from a rest position, measuring a first end position attained by the rotor under the action of the direct current, and controlling, during operation, the intensity of the alternating current with which the stator is excited in a manner wherein the rotor does not reach the first end position or reaches it at a reduced speed.

10 Claims, 2 Drawing Sheets

U.S. PATENT DOCUMENTS 6,084,320 A * 7/2000 Morita et al. ..... 310/12.33
6,089,836 A * 7/2000 Seo ..... 417/417
6,153,951 A * 11/2000 Morita et al. ..... 310/12.27
6,231,310 B1 * 5/2001 Tojo et al. ..... 417/44.1
6,238,192 B1 * 5/2001 Lee ..... 417/417
6,326,706 B1 * 12/2001 Zhang ..... 310/12.31
6,506,032 B2 1/2003 Kawahara et al.
6,877,326 B2 * 4/2005 Kim ..... 62/6
7,626,289 B2 * 12/2009 Her ..... 310/12.04
2001/0005320 A1 6/2001 Ueda et al.
2009/0058200 A1 * 3/2009 Rockelein et al. ..... 310/12
2009/0304525 A1 * 12/2009 Reinschke ..... 417/53
2010/0047079 A1 * 2/2010 Reinschke ..... 417/44.1

* cited by examiner

METHOD FOR ADJUSTING A PISTON IN A LINEAR COMPRESSOR

BACKGROUND OF THE INVENTION

The present invention relates to a method for operating a linear compressor, in particular for a refrigerator. A linear compressor of this kind is known for example from U.S. Pat. No. 6,506,032B2 and U.S. Pat. No. 6,642,377B2. It comprises a reversing linear drive with a winding and an armature that can be displaced by a magnetic field generated by the winding against a spring force and a compression chamber, in which a piston is coupled to the armature in a displaceable manner. In operation, an alternating current is applied to the winding in order to drive an oscillating movement of the armature.

While with a conventional rotary-driven compressor the amplitude of motion of the piston is strictly specified, this is not the case with a linear compressor. The armature can oscillate with different amplitudes depending upon the electrical drive power supplied to the winding and accordingly the piston stroke is also variable.

The lower the drive power, and accordingly also the amplitude of the armature, the greater the dead volume of the pump chamber at the upper inversion point of the piston path. A large dead volume results in a low compressor efficiency since the work used to compress the gas in the dead volume is not used and, after overcoming the top dead center, the gas expands again and thereby drives the piston back.

If, on the other hand, the drive power applied to the winding is too high, the amplitude of the armature can become so high that the piston strikes a boundary of the compression chamber. This results in the development of a loud noise and possibly also damage to the compressor. In addition, the oscillation of the armature and the driving alternating current fall out of phase so that the drive is less effective for this reason as well.

In order to be able to operate a linear compressor in a stable way with a high degree of efficiency, it is therefore necessary to monitor the amplitude of the armature and to control the alternating current applied to the winding in such a way that the amplitude always remains just under a limit value the exceeding of which causes the piston to strike a boundary.

Tolerances during the production of linear compressors can mean that the path which the armature is able to cover from its equilibrium position until the piston strikes a boundary can vary from one linear compressor to another. If, taking into account the production tolerances, the armature stroke is defined uniformly for all linear compressors so that the piston is not able to strike the boundary, the dead volumes differ greatly from one compressor to another and hence so does the efficiency.

A further problem is that the equilibrium position adopted by the armature when the compressor is switched off can differ depending upon the pressure acting on the piston and prevailing in the compression chamber. When using the linear compressor to compress refrigerants in a refrigerator, different pressures can easily occur depending on the average temperature or the ratio of gaseous to liquid refrigerant in the device's refrigerant circuit. When a refrigerator is put into operation for the first time or put into operation after a lengthy outage period and the refrigerant circuit has to be cooled down from room temperature, at first the pressure in the refrigerant circuit is higher than it is with an operational device in which the refrigerating compartment, and consequently also at least a part of the refrigerant, is much colder than room temperature. An oscillation amplitude which produces a small usable dead volume with an operational device can be insufficient in the case of new commissioning, since here the rest position about which the armature is oscillated is displaced. If this results in a large dead volume, in extreme cases, the efficiency of the compressor can be so greatly impaired that it is not possible to cool down the device in the correct manner.

BRIEF SUMMARY OF THE INVENTION

The object of the present invention is to provide a method for operating a linear compressor which avoids the above-described problems.

According to the invention, the object is achieved in that, with a linear compressor comprising a linear drive with a winding and an armature that can be displaced by the magnetic field of the winding against a spring force and a compression chamber, in which a piston is coupled to the armature in a displaceable manner, wherein, in operation, an alternating current is applied to the winding in order to drive an oscillating movement of the armature, prior to operation, a direct current with a first polarity is applied to said winding in order to displace the armature out of a rest position, in that a first end position attained by the armature under the action of the direct current is measured and in that, during operation, the intensity of the alternating current with which the winding is excited is controlled in such a way that the armature does not reach the first end position or reaches it a reduced speed.

The application of the direct current and the measurement of the armature position resulting therefrom produces a measured value for the maximal permissible deflection of the armature in which both production tolerances and a displacement of the rest position of the armature caused by the pressure in the compression chamber is automatically taken into account.

Preferably, the first polarity of the direct current is defined so that displacement of the armature resulting from the action of the direct current causes the piston to be moved toward a valve plate of the compression chamber, since, in this direction, the freedom of motion of the piston is necessarily restricted and precise regulation of the piston stroke is required to ensure a small dead volume and hence good efficiency.

It can further be provided that, prior to operation, a direct current with a polarity opposite to the first polarity is applied to the winding, that a second end position attained by the armature under the action of this direct current is measured and that, during operation, the intensity of the alternating current with which the winding is excited is controlled in such a way that the armature also does not reach the second end position or reaches it at a reduced speed. In this way, the freedom of motion of the piston is measured in both directions and the available freedom of motion of the piston can be utilized to the optimum extent independently of scatter caused by production tolerances.

Alternatively, it is possible to calculate a second end position at a predefined distance from the first end position.

The intensity of the direct current is expediently gradually increased in order to prevent the piston striking a boundary at a high speed.

Preferably, during the increasing of the current intensity, the position of the armature is repeatedly measured and the end position is defined as a position of the armature beyond which the armature does not move in the case of a further increase in the current intensity. Namely, as long as the deflection is only counteracted by the spring force and possibly the pressure in the compression chamber, it may be assumed that an increase in the current intensity of the direct current also results in an increase in the deflection unless the piston has reached the boundary.

Alternatively, the end position can be defined as a position of the armature in which it triggers a proximity sensor. A proximity sensor of this kind can, for example, be a light barrier.

In order to start the oscillating movement of the armature, preferably, an alternating current with which the charges of the positive and negative half-waves increase over the course of time is applied to the winding so that the amplitude of the oscillating movement also increases over the course of time. This makes it possible to follow the development of the amplitude in dependence on the charges of the half-waves and proportion their increase in such a way that none of previously defined end positions is exceeded.

In particular due to a displacement of the rest position of the armature due to the pressure prevailing in the compression chamber, it can be necessary to regulate the charges of the positive and negative half-waves separately in order to ensure in each case the same distance of the two inversion points of the oscillating movement from the first or second end position.

BRIEF DESCRIPTION OF THE DRAWINGS

Further features and advantages of the invention may be found in the following description of exemplary embodiments with reference to the attached figures, which show.

DETAILED DESCRIPTION OF THE PRESENT INVENTION

Figure 1:
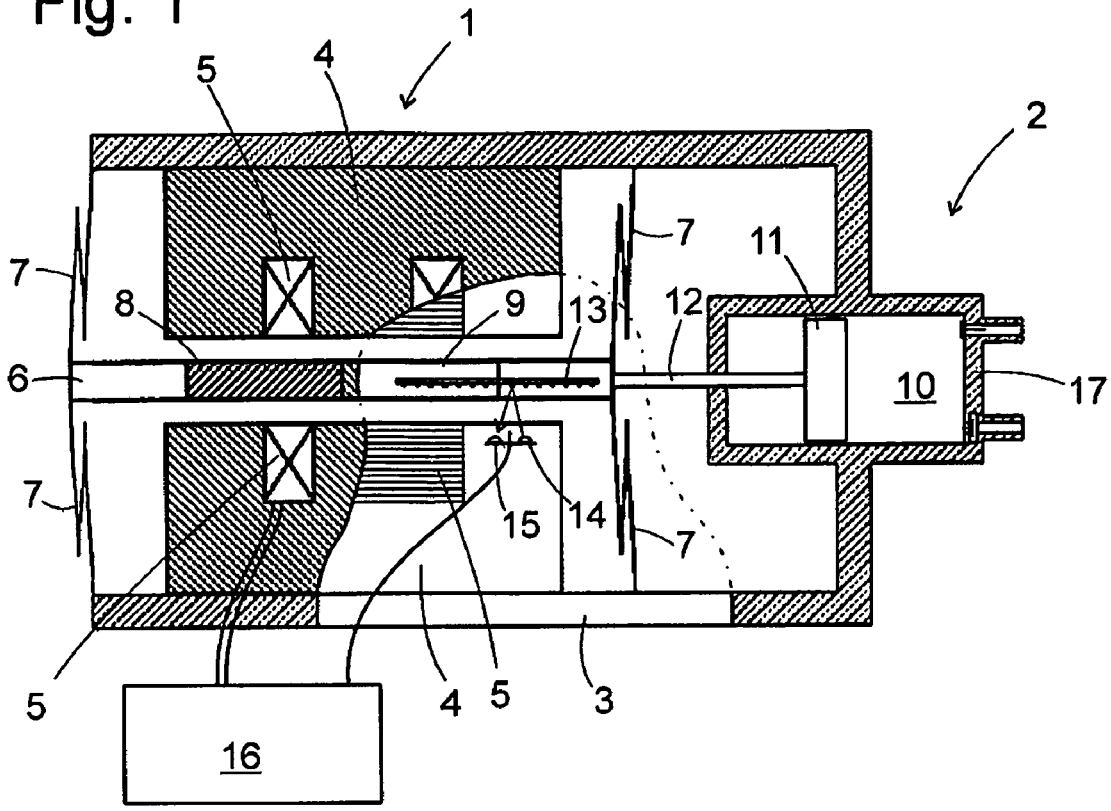
FIG. 1 a schematic view, partially a top view, partially in section, of a linear compressor FIG. 2 the temporal development of a direct current applied to the windings of the linear compressor in FIG. 1 and of the measured value of the armature deflection resulting therefrom and FIG. 3 the temporal development of the oscillation amplitude and the charges of the positive and negative half-waves of the winding current on the actuation of the oscillating movement.

FIG. 1 is a schematic view of a linear compressor with a linear drive 1 and a compressor unit 2 which is held in a frame 3, which is here U-shaped. Mounted on two parallel limbs of the frame 3 are iron cores 4 facing each other with an E-shaped cross section and windings 5. An armature 6 is suspended in an air gap between the iron cores 4 with the aid of diaphragm springs 7 which hold the armature 6 in an easily movable way in the longitudinal direction of the air gap and rigidly in the transverse direction. The armature 6 comprises two permanent magnets 8, 9 with antiparallel polarization which attempt to align themselves in a magnetic field generated by the windings 5 and hence, depending upon the conduction direction through the windings 5, drive the armature 6 to the left or right in the perspective view shown in the figure.

The compressor unit 2 comprises a compression chamber 10 which is bounded on one side by a movable piston 11. The piston 11 is rigidly connected to the armature 6 by means of a piston rod 12. An excess pressure in the compression chamber 10 causes the rest position of the armature 6 to be displaced slightly toward the left compared to a position in which the flat springs 7 are not under tension.

A supporting plate 13 provided with alternate reflective or optically absorbing strips is mounted on the armature 6. A first light barrier with a light source 14, which emits a focused light beam onto the supporting plate 13 and a light sensor 15 directed toward the supporting plate 13 is mounted on one of the iron cores 4. Depending upon whether the light beam from the light source 14 arrives at a reflective or an absorbing strip of the supporting plate 13, the light sensor 15 receives more or less light.

Alternatively, instead of the supporting plate 13, it is also possible for a comb-like structure to be mounted on the armature 6 and the light source 14 and light sensor 15 of the light barrier to be mounted on the iron cores 4 on both sides of the comb structure so that, depending upon the position of the armature 6, a tooth of the comb structure shades the light sensor 15 or the light beam from the light source 14 reaches the light sensor 15 through a gap between two teeth. Instead of a comb structure, it is also possible to have a transparent support provided with interspaced opaque strips.

A second light barrier (not shown) is arranged offset by a quarter period of the regular strip arrangement.

Connected to the light barriers, there is a control circuit 16 which applies current to windings 5.

Figure 2:
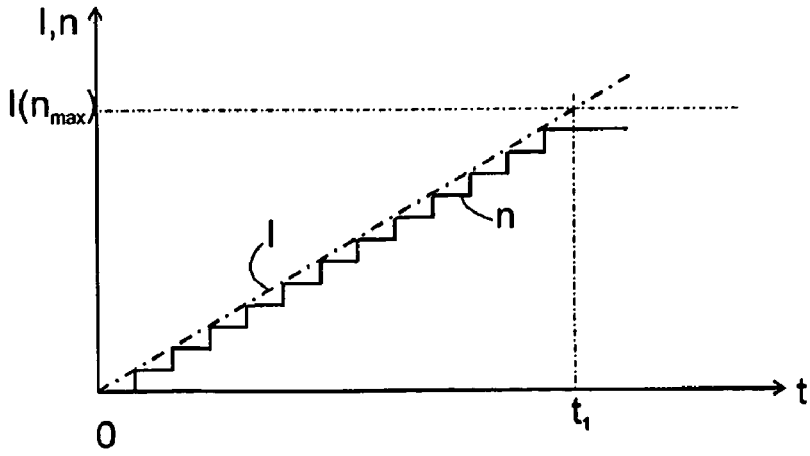

The mode of operation of the control circuit on the commissioning of the linear compressor is explained with reference to FIGS. 2 and 3. At a time t=0, the control circuit 16 receives a start command from outside, for example from a refrigerator regulator in which the linear compressor in FIG. 1 is installed. The control circuit 16 then applies a direct current, whose current intensity I increases, as indicated by a dash-dot line in the diagram in FIG. 2, linearly with the time t to the windings 5. In proportion to the current intensity I, there is an increase in the magnetic force acting on the armature 6 and this drives the armature 6 toward the right in the perspective view in FIG. 1. In the depiction in FIG. 2, it is assumed for purposes of simplification that the resulting displacement of the armature 6 is linearly proportional to the current intensity I. However, the principle of the invention is also applicable if this is not exactly the case:

With increasing displacement of the armature 6, the strips of the supporting plate 13 pass the light barriers one after the other. By means of a comparison of the phases of the counting pulses supplied by the light barriers, the control circuit 16 identifies the direction in which the armature 6 is moving and, each time that a strip passes the first light barrier 14,15, the control circuit increments (or decrements, depending upon the direction of movement determined) a counter the count value n of which is representative of the path traveled by the armature 6 from its rest position. The count value n therefore forms a step function of the time t which is also shown in the diagram in FIG. 2.

If the current intensity I is strong enough to bring the piston 11 into contact with the valve plate 17 of the compressor unit 2, the count value n does not increase any further even if the current intensity continues to increase. This is recognized by the control circuit 16 at a time, designated $t_1$ in FIG. 2, at which the current intensity I reaches a value $I(n_{max})$, at which an expected increment of n on the continuation of the previously observed relationship between I and n does not occur.

According to a first embodiment, the freedom of motion of the armature 6, measured in steps of said counter, is a fixed predefined whole number N which is stored in the control circuit 16. If the control circuit exceeds the count value with the number N corresponding to the contact of the piston 11 with the valve plate 17, calibration of the position measurement is achieved: the limits of the permissible motion range of the armature 6 correspond in each case to a count value of 0 or N. By incrementing or decrementing the strips detected by the light barrier, depending upon the direction of travel of the armature 6, the control circuit 16 "recognizes" the location of the armature 6 at any time.

According to a second embodiment, from a time $t_1$, the control circuit reduces the current intensity I in the windings 5 until its polarity is inverted and in the meantime in the opposite direction counts the strips which pass the light barrier from zero upward. This happens until once again an increase of the amount of the current intensity no longer results in a further increase in the counter reading. The counter reading N obtained in this way represents a measured value of the actual freedom of motion of the armature 6; it is used in the same way as described above for the fixed predefined count value N and explained below in more detail.

Figure 3:
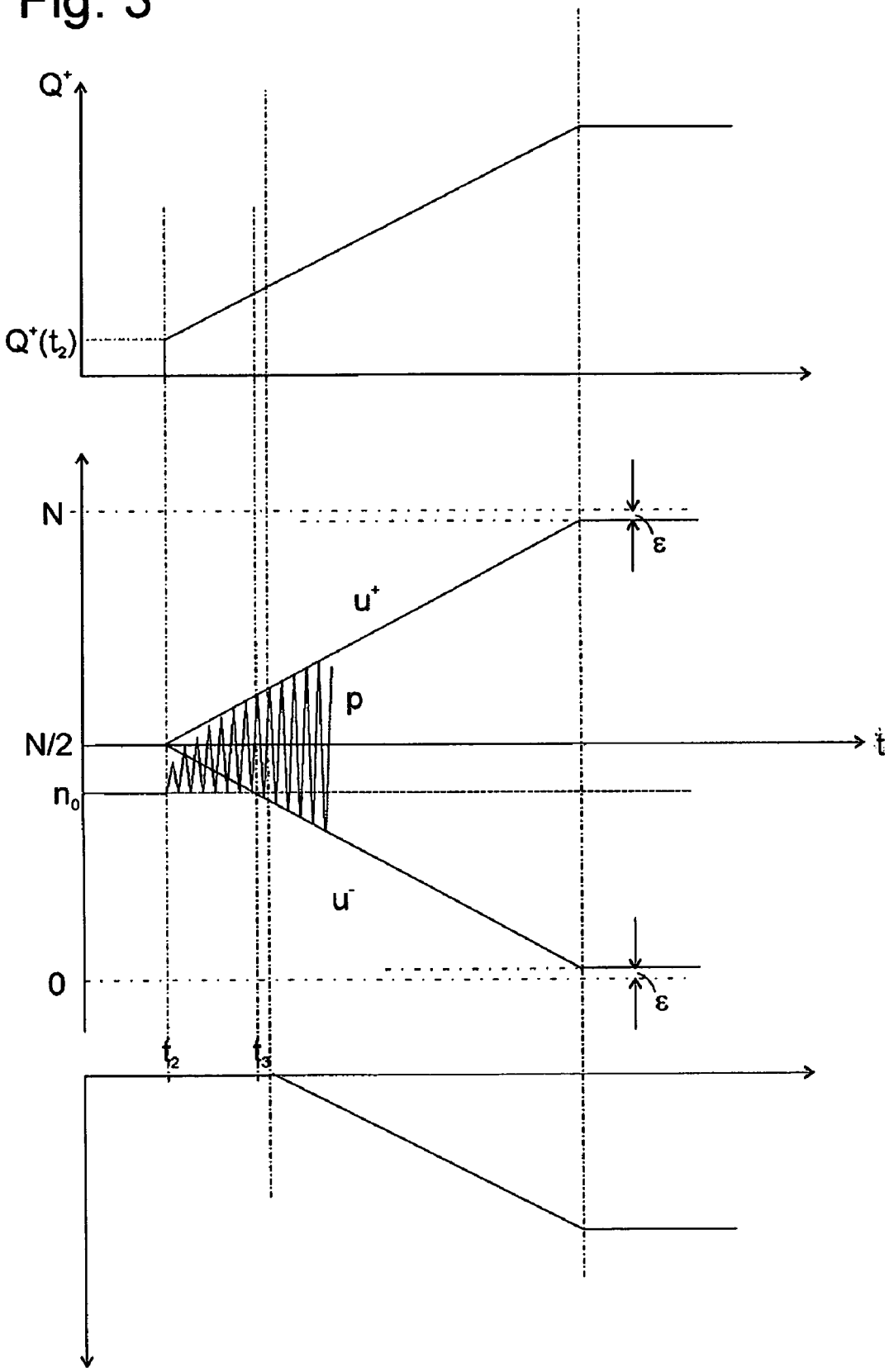

The diagrams in FIG. 3 illustrate the recording of the oscillation operation of the linear compressor. The middle diagram is a schematic illustration of the temporal development of the position of the armature 6 and its desired inversion points, correspondingly, the upper and the lower diagrams each show the corresponding temporal development of the charges Q+, Q− of the positive and negative half-waves of a excitation current emitted by the control circuit 16 to the windings 5.

In order now to actuate the oscillating movement of the armature 6, the control circuit first specifies the armature position corresponding to the count value N/2 as the center point of the oscillating movement. The original rest position of the armature then corresponds to a count value designated $n_o$ which will generally be different from N/2. At the time $t_2$ in FIG. 3, the control circuit starts to excite the oscillating movement. In order to enable the amplitude of the oscillation to increase gradually, desired inversion points $u^+u^-$ are specified for the armature oscillation, which remove themselves symmetrically from N/2 over the course of time, for example as linear functions of the time $u^+=N/2+a(t-t_2)$, $u-=N/2-a(t-t_2)$ in order finally to adopt stationary values N-ϵ or ϵ, as shown in the middle diagram in FIG. 3. Hereby, ϵ represents a safety distance of a few counter steps which serves reliably to prevent the piston from striking a boundary in stationary mode. A typical sequence of the armature movement is depicted as a curve p in the middle diagram in FIG. 3. At the time $t_2$, the armature 6 is significantly below the curve $u^+$ of the upper inversion point. The control circuit 16 therefore first only applies positive half-waves to the windings in order to raise the armature. The temporal development of the charge $Q^+$ of the upper half-waves is depicted in the upper diagram in FIG. 3; it starts with an initial value $Q^+(t_2)$ at the time t2, which is proportional to the deviation between the rest position $n_o$ of the armature and the desired center point N/2 of the oscillating movement of said armature and, like the desired position $u^+$ of the upper inversion point, increases over time t. At the time $t_3$, the desired position of the lower inversion point $u^-$ crosses the rest position no. The control circuit 16 now starts to emit negative half-waves as well. The temporal development of their charge Q− is shown in the lower diagram in FIG. 3.

The charges $Q^+$, $Q^-$ increase until the desired ratings $u^+$, $u^-$ have reached the end positions N-ϵ or ϵ and hence stationary operating mode of the linear compressor is reached. Once again, here the charges of the positive and negative half-waves are different in order to compensate the deviation between the rest position $n_o$ of the armature 6 influenced by the pressure of the refrigerant in the compression chamber and the center position N/2 of the armature movement.

If, during the course of the operation of the linear compressor, the refrigerator cools down and the refrigerant pressure, against which the compressor unit 2 works, is reduced, there is also a displacement of the rest position which the armature 6 would adopt when the drive is switched off. Unless counteracted, this would result in a displacement of the entire armature movement toward the right in FIG. 1 and hence finally to the piston 11 striking the valve flap 17. As the control circuit 16 reduces the charge of the positive half-waves when it detects a movement of the armature to above the upper desired inversion point N-ϵ and accordingly increases the charge of the lower half-waves, a displacement of the movement of this kind is prevented so that the compressor unit 2 always works with a minimum dead volume without the piston 11 in the compression chamber 10 striking anything.

The invention claimed is:

1. A method for operating a linear compressor including a linear drive with a stator and a rotor configured for displacement by a magnetic field of the stator against a spring force, and a compression chamber which is delimited by a displaceable piston coupled to the rotor during the operation of which an alternating current is applied to the stator in order to drive the rotor in an reciprocating manner, the method comprising the steps of applying, prior to operation, a direct current with a first polarity to the stator in order to displace the rotor from a rest position, measuring a first end position attained by the rotor under the action of the direct current, and controlling, during operation, the intensity of the alternating current with which the stator is excited in a manner wherein at least one of the rotor does not reach the first end position and the rotor reaches the first end position a reduced speed.

2. The method according to claim 1 wherein the step of applying a direct current to the stator includes selecting a first polarity in a manner wherein the piston is moved toward a valve plate of the compression chamber.

3. The method according to claim 2 and further comprising the step of regulating the charges of the positive and the negative half-waves separately in order to maintain in each case the same distance of the two inversion points of the reciprocating movement from at least one of the first end position and the second end position.

4. The method according to claim 1 and further comprising the steps of applying, prior to operation, a direct current with a polarity opposite to the first polarity to the stator; measuring a second end position attained by the rotor under the action of the direct current and controlling, during operation, the intensity of the alternating current with which the stator is excited in a manner wherein at least one of the rotor does not reach the first end position and the rotor reaches the first end position a reduced speed.

5. The method according to claim 1 and further comprising the step of calculating a second end position at a predefined distance from the first end position.

6. The method according to claim 1 wherein the step of applying direct current includes gradually increasing the intensity of the direct current.

7. The method according to claim 6 and further comprising the steps of repeatedly measuring, during the increasing of the current intensity, the position of the rotor and defining the rotor end position at a position of the rotor beyond which the rotor does not move on a further increase of the current intensity.

8. The method according to claim 6 and further comprising the step of defining a position of the rotor in which the rotor triggers a proximity sensor as the end position.

9. The method according to claim 8 wherein the step of defining an end position includes providing the proximity sensor in the form of a light barrier.

10. The method according to claim 1 and further comprising the step of starting the reciprocating movement of the rotor by applying an alternating current to the stator wherein the charges of the positive and the negative half-waves increase over time.

* * * * *